US006230841B1

(12) United States Patent
Valore

(10) Patent No.: US 6,230,841 B1
(45) Date of Patent: May 15, 2001

(54) TRACK LADDER

(75) Inventor: Nicholas J. Valore, Avonmore, PA (US)

(73) Assignee: Melfred Inc., Pittsburgh, PA (US)

( * ) Notice: Subject to any disclaimer, the term of this patent is extended or adjusted under 35 U.S.C. 154(b) by 0 days.

(21) Appl. No.: 09/350,554

(22) Filed: Jul. 9, 1999

Related U.S. Application Data

(60) Provisional application No. 60/092,202, filed on Jul. 9, 1998.

(51) Int. Cl.[7] ..... E04G 3/14; E04G 3/08

(52) U.S. Cl. ..... 182/39; 182/38; 182/15; 248/240; 248/298.1

(58) Field of Search ..... 182/39, 38, 15, 182/97, 86, 84; 248/240, 240.3, 298.1, 295.11, 285.1

(56) References Cited

U.S. PATENT DOCUMENTS

| | | | |
|---|---|---|---|
| 92,527 | 7/1869 | Hartman . | |
| 356,375 | 1/1887 | Perkins . | |
| 470,374 | 3/1892 | Fisher . | |
| 528,824 | 11/1894 | Sumner . | |
| 553,108 | 1/1896 | Davison . | |
| 862,622 | 8/1907 | Eller . | |
| 907,401 | 12/1908 | Prouty . | |
| 938,016 | 10/1909 | Niblack . | |
| 1,118,385 | 11/1914 | Timmerman . | |
| 1,320,740 | 11/1919 | Coghlin . | |
| 1,341,996 | 6/1920 | Plucienski . | |
| 1,439,388 | 12/1922 | Willett . | |
| 2,186,119 | 1/1940 | Moen | 228/15 |
| 2,362,170 | 11/1944 | Swaisgood | 304/29 |
| 3,391,757 * | 7/1968 | Duke et al. | 182/38 |
| 3,735,838 | 5/1973 | Greenleaf | 182/15 |
| 3,997,024 | 12/1976 | Fredericks et al. | 182/17 |
| 4,044,857 | 8/1977 | Guerette | 182/17 |
| 4,768,617 | 9/1988 | Mason et al. | 182/1 |
| 5,148,889 | 9/1992 | Fenwick et al. | 182/17 |
| 5,653,307 | 8/1997 | Kerr | 182/38 |

FOREIGN PATENT DOCUMENTS

| | | |
|---|---|---|
| 691905 | 10/1930 | (FR) . |
| 832727 | 10/1938 | (FR) . |
| 271149 | 1/1930 | (IT) . |

OTHER PUBLICATIONS

Storage Wall System (Lista), Catalog SW–255.
Cotterman "Rolling Wood Ladders", Bulletin WL–188, Sep. 26, 1995.
Cotterman Co., Single Track Ladder Pricing effective Jul. 1, 1995.

* cited by examiner

*Primary Examiner*—Daniel P. Stodola
*Assistant Examiner*—Hugh B. Thompson
(74) *Attorney, Agent, or Firm*—Webb Ziesenheim Logsdon Orkin & Hanson, P.C.

(57) ABSTRACT

A track ladder that includes a ladder frame, plurality of steps secured to the ladder frame and a carriage assembly secured to the ladder frame. The ladder frame rides on an upper track and a lower track and adapted to move in a horizontal direction and pivot about a vertical axis.

17 Claims, 5 Drawing Sheets

TRACK LADDER

CROSS-REFERENCE TO RELATED APPLICATION

This application claims the benefit of U.S. Provisional Application Ser. No. 60/092,202, filed Jul. 9, 1998.

BACKGROUND OF THE INVENTION

1) Field of the Invention

The present invention relates to movable ladders mounted to shelving.

2) Description of the Prior Art

U.S. Pat. No. 5,653,307 to Kerr discloses a dual track mounted pivoting ladder assembly. This ladder assembly has several problems, namely, it requires substantial hardware to secure two carriages to each other. Further, the dual track mounted pivoting ladder assembly disclosed in U.S. Pat. No. 5,653,307 cannot be adjusted to fit between variably spaced shelving.

Therefore, it is an object of the present invention to provide a dual track mounted pivoting ladder assembly that is easy to assemble and can fit variable spaced tracking.

SUMMARY OF THE INVENTION

The present invention is a ladder system for positioning a ladder relative to a storage rack having a front face and located at one side of an aisle, and includes a ladder having upper and lower ends, with the lower end being engageable with a horizontal support surface. An upper track is located near the front face of the storage rack and a lower track extends parallel and is vertically spaced below the upper track and located near the front face of the storage rack. A movable carriage assembly is attached to the upper track and lower track. The movable carriage assembly includes a first movable frame having a horizontal arm with first and second ends, the horizontal arm extends parallel to and is located slightly below the upper track. A pair of longitudinally spaced upper roller assemblies are engageable with the upper track. Brackets fixedly connect the roller assemblies to the first and second ends of the horizontal arm. The first movable frame also includes a generally cylindrically-shaped vertical strut with an upper end portion and a lower end portion. The upper end portion is connected to the horizontal arm generally midway between the first and second ends. The lower end portion of the vertical strut is provided with a pair of lower rollers which are engageable with opposing portions of the lower track.

The movable carriage assembly also includes a second movable frame having a horizontal ladder support arm with first and second ends and a vertical arm having an upper end portion. The first end of the horizontal ladder support arm is connected to and perpendicular to the upper end portion of the vertical arm. The vertical arm is a cylindrically-shaped sleeve slidably received by the cylindrically-shaped vertical strut. The vertical strut and vertical arm extend along the same vertical axis. A bushing or a spacer is received by the vertical strut and permits vertical adjustability of the height of the second movable frame. A lower end of the vertical arm rests on an upper surface of the bushing.

An arrangement is provided for mounting the upper end of the ladder on the horizontal ladder support arm. The vertical arm, which is pivotably received by the vertical strut, permits the second movable frame and the ladder to swing in a lateral direction relative to the first movable frame and thereby reposition the ladder relative to the front face of the storage rack. The upper roller assemblies and the pair of lower rollers are movable along the upper and lower tracks, respectively, as the carriage assembly and the ladder are moved in the longitudinal direction parallel to the front face of the storage rack.

The height of the second movable frame can be adjusted through the use of spacer sleeves received by the vertical strut.

The present invention is also a ladder that includes a ladder frame, a plurality of steps secured to the ladder frame and a carriage assembly secured to the ladder frame. The carriage assembly includes a sleeve and a rod slidably received by the sleeve. The carriage assembly extends along a longitudinal axis. One of the sleeve and the rod is secured to the ladder frame and the other rod and sleeve is configured to be secured to a structure, such as a storage rack. The ladder frame and the one of the sleeve and the rod secured to the ladder frame are adapted to pivot about a longitudinal axis relative to the other of the sleeve and the rod.

The ladder frame includes a lower end and an upper end. The carriage assembly is secured to the upper end of the ladder frame. A platform is secured to the ladder frame and is positioned above the steps. The steps extend along the longitudinal axis. Rollers are attached to the lower end of the ladder frame. The rollers are adapted to roll on a floor.

Preferably, the sleeve is secured to the ladder frame and the rod is secured to a moveable frame. The moveable frame includes an upper horizontal arm, a lower horizontal arm and two side arms. The upper horizontal arm is secured to the lower horizontal arm through the two side arms. The rod extends through the upper horizontal arm and the lower horizontal arm. The sleeve is positioned between the upper horizontal arm and the lower horizontal arm.

A stop is secured to an upper end of the rod coacting with the upper horizontal arm. Preferably, the stop includes a flange. The moveable frame further includes a collar secured to the upper horizontal frame. The collar receives the rod and is positioned between the washer and the upper horizontal frame. The washer prevents downward movement of the rod relative to the moveable frame and the collar prevents upward movement and downward movement of the rod relative to the moveable frame.

Further, the ladder may include an adjustment sleeve slidably received by the rod and positioned between the sleeve and the moveable frame. The adjustment sleeve is positioned below the sleeve. The sleeve rests on the adjustment sleeve. The adjustment sleeve is configured to adjust the height of the sleeve relative to the floor.

Preferably, the upper roller assembly is attached to the moveable frame and the lower roller assembly is attached to the rod. The sleeve is positioned between the upper roller assembly and the lower roller assembly. The lower roller assembly is secured to a rod clamp.

A horizontal extending arm is attached to the sleeve and the ladder frame. An angled strut is secured to the horizontally extending arm and the sleeve. The angled strut is secured to the sleeve between the ends of the sleeve.

The present invention is also a track ladder incorporating the above identified ladder and further including an upper track extending in a horizontal direction, a lower track extending in the horizontal direction, the upper track and the lower track spaced apart from and parallel to each other. The upper roller assembly is received by the upper track and the lower roller assembly is received by the lower roller track. The present invention is also a track ladder system that further includes a storage rack having a front face wherein the upper track and the lower track are attached to the front face.

The present invention is also a kit for securing a track ladder to a storage rack, the kit includes a plurality of track segments for securing to a storage rack, a ladder having a ladder frame and a plurality of steps secured to the ladder frame, a carriage assembly configured to be secured to the ladder frame, the carriage assembly including a sleeve and a rod slidably received by the sleeve, a movable frame secured to the rod, an upper roller assembly configured to be attached to the moveable frame and a lower roller assembly configured to be attached to the rod.

The present invention is also a method for attaching the track ladder to a storage rack incorporating the above-identified kit. The method includes the steps of securing the plurality of track segments to the storage rack defining an upper track and a lower track wherein the upper track extends in a horizontal direction and is positioned above the lower track which extends in the horizontal direction and is parallel to the upper track; securing the upper roller assembly to the upper track and the lower roller assembly to the lower track; securing the moveable frame to the upper roller assembly; passing the rod through the sleeve; securing the rod to the lower roller assembly; and securing the ladder to the sleeve, whereby the ladder can move along the upper track and the lower track in a horizontal direction and rotate about a vertical axis passing through the rod. The method can include the further step of attaching the adjustment sleeve to the rod for the sleeve to rest upon.

DESCRIPTION OF THE PREFERRED EMBODIMENTS

Figure 1:
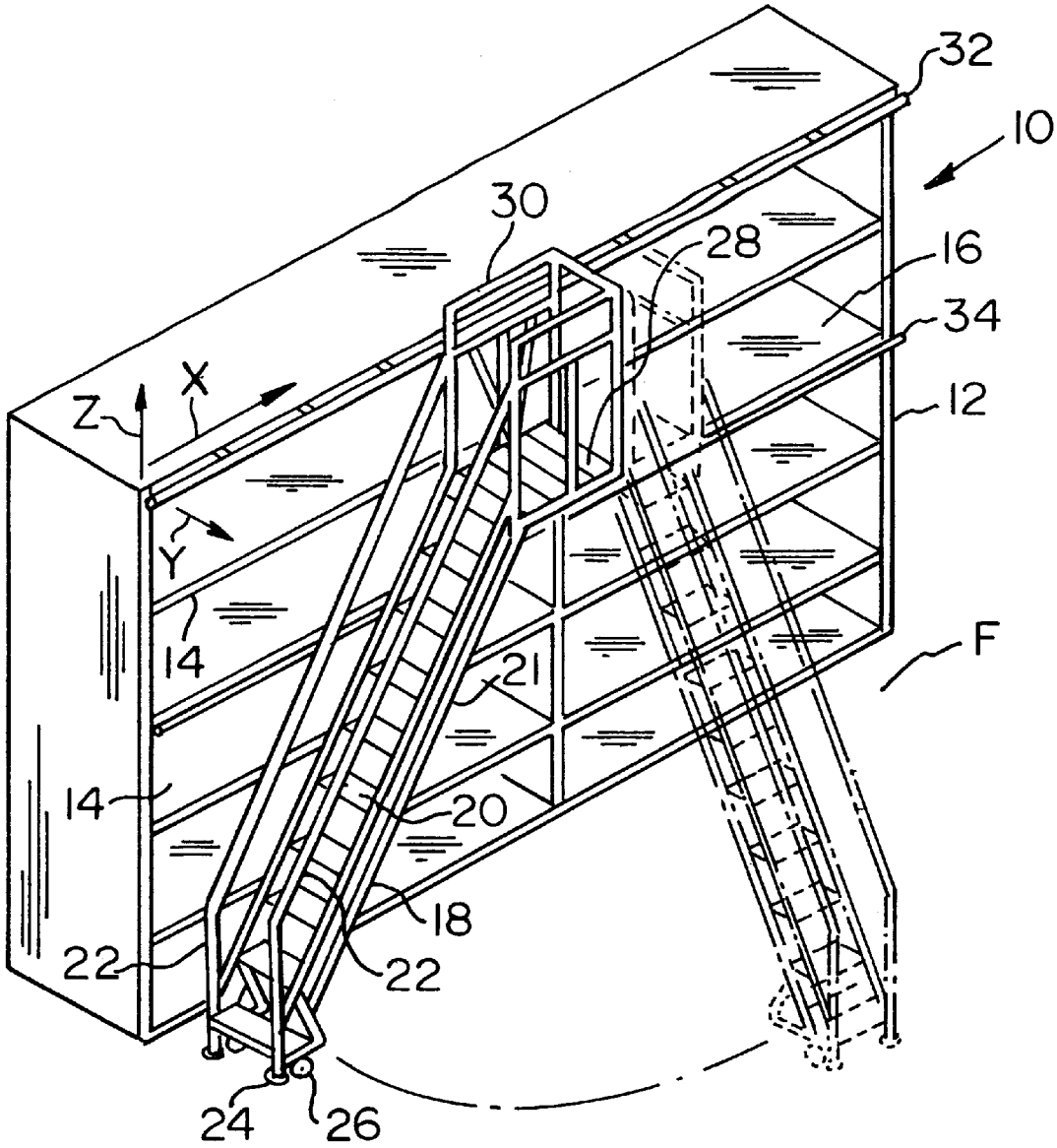
FIG. 1 is a top perspective view of a ladder system mounted on a front face of a storage rack and showing the ladder in two different positions which are 90° apart made in accordance with the present invention.

FIG. 1 shows a dual track mounted pivoting ladder assembly 10 made in accordance with the present invention. The dual track mounted pivoting ladder assembly 10 mounts to a structure, such as a storage rack 12, that includes a plurality of shelving 14 that extends in the longitudinal direction defined by an axis X. The shelving 14 is spaced in a vertical direction defined by an axis Z. The storage rack 12 includes a front face 16 contained within a plane that is contained within the X and Z axes.

The dual track mounted pivoting ladder assembly 10 includes a ladder 18 having a plurality of steps 20 extending in the vertical direction defined by the axis Z.

The ladder 18 also includes a ladder frame 21 and handles 22 secured to the steps 20. Spring-loaded stops 24 are provided at a lower end of the ladder 18. Also, rollers 26 are provided on the lower end of the ladder 18. An upper end of the ladder 18 includes a platform 28 which is secured to a movable carriage assembly 30. An upper track 32, which extends along the axis X in a horizontal direction, is secured to the storage rack 12 and a lower track 34 extending along an axis parallel to the axis X is also secured to the storage rack 12. The upper track 32 and the lower track 34 are vertically spaced apart from each other along the axis Z. The upper track 32 and the lower track 34 can be made up of a plurality of segments.

Figure 2A:
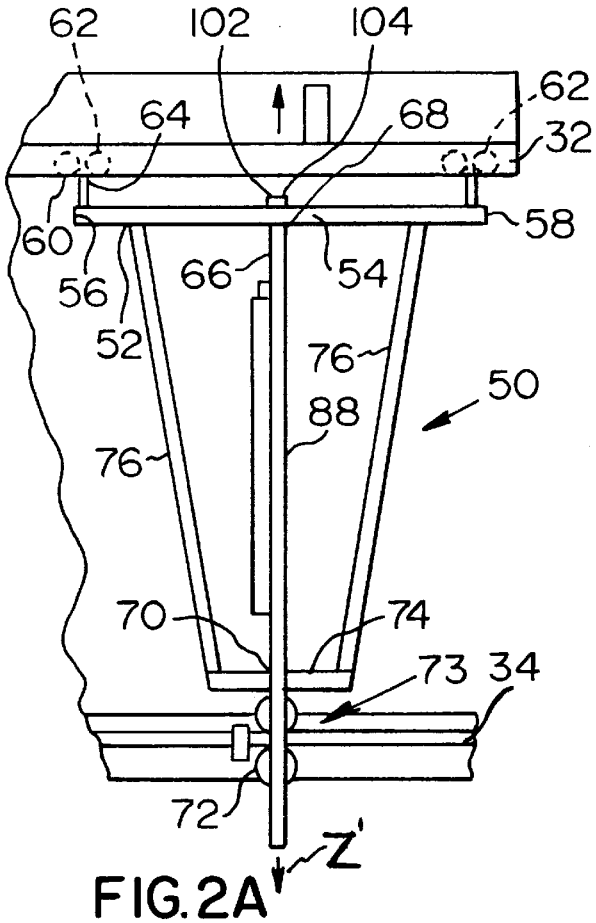
FIG. 2A is a front elevational view of a portion of the ladder system shown in FIG. 1.
Figure 2B:
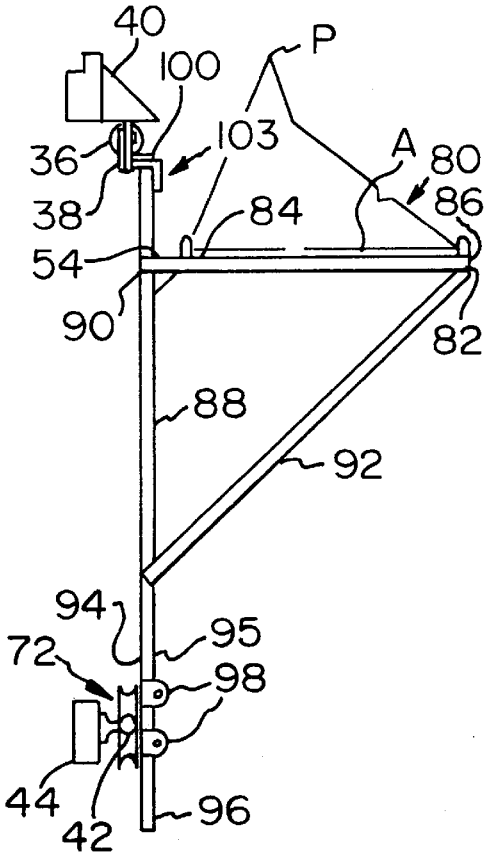
FIG. 2B is a side elevational view of the portion of the ladder systems shown in FIG. 2B.
Figure 2C:
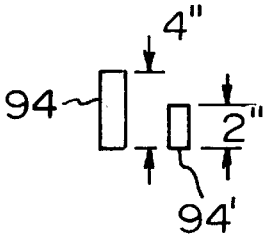
FIG. 2C is an elevational view of two spacers.
Figure 3A:
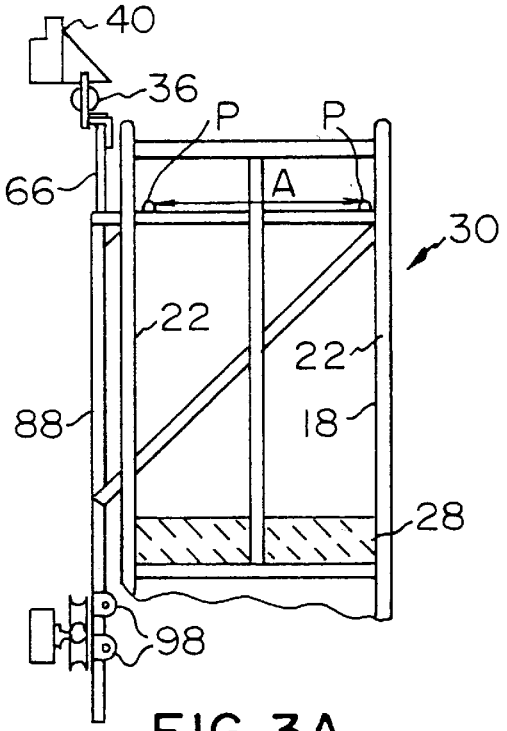
FIG. 3A shows an elevational side view of a portion of the ladder system shown in FIG. 1 at different ladder positions.
Figure 3B:
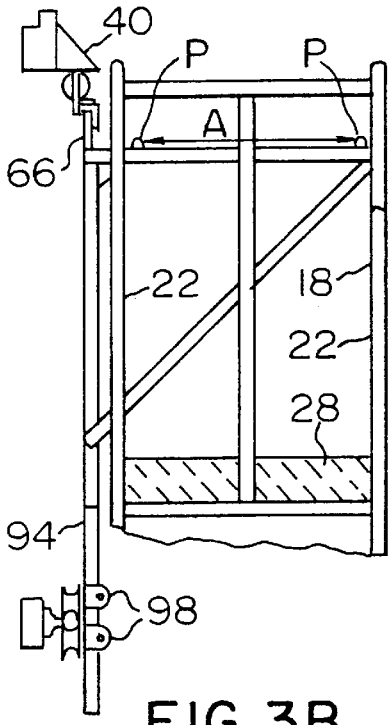
FIG. 3B shows an elevational side view of the portion of the ladder system shown in FIG. 3A with a spacer.
Figure 4:
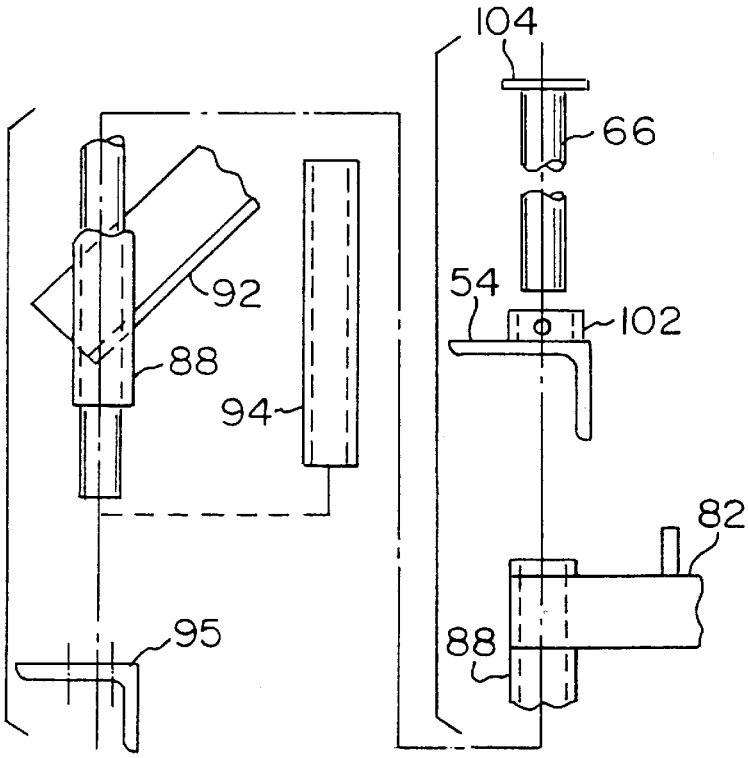
FIG. 4 shows fragmentary elevational view of a top portion and a bottom portion of the ladder system carriage.
Figure 5:
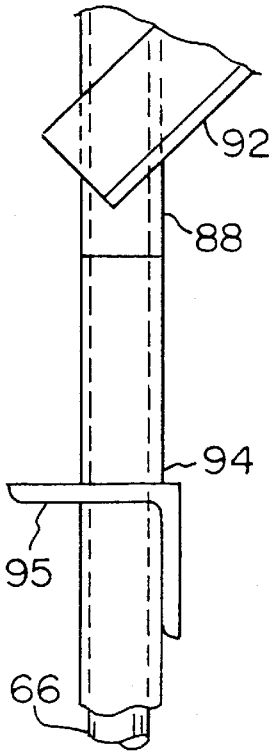
FIG. 5 is an elevational view of a portion of the ladder system showing an adjustment spacer or a spacer sleeve.
Figure 6:
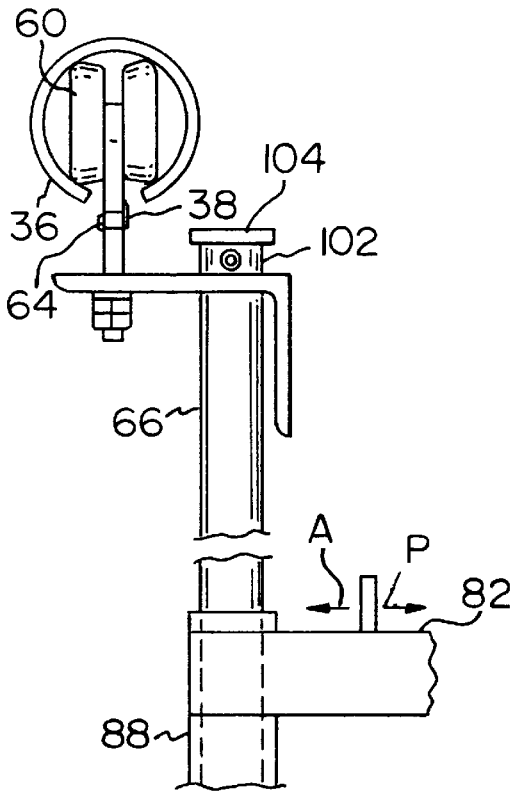
FIG. 6 is a side elevational view of an upper portion of the ladder system shown in FIG. 1.

Referring now to FIGS. 2*a* and 2*b*, the upper track 32 includes a cylindrically-shaped tube 36 having a longitudinally extending slot 38 provided in a lower portion of the cylindrically-shaped tube 36. The cylindrically-shaped tube 36 is mounted to the storage rack 12 through a mount 40. The lower track 34 includes a longitudinally extending cylindrical rod 42 attached to the storage rack 12 through a mount 44.

The dual track mounted pivoting ladder assembly 10 also includes a movable carriage assembly 50. The movable carriage assembly 50 includes a first movable frame 52 that includes an upper horizontal arm 54 which extends in the longitudinal direction along the axis X. The upper horizontal arm 54 includes a first end 56 and a second end 58. Two spaced apart roller assemblies or upper roller assemblies 60 are secured to the first end 56 and the second end 58 and rotatably coact with the cylindrically-shaped tube 36.

Each of the roller assemblies 60 includes a plurality of pivotable wheels 62 pivotally secured to wheel brackets 64. The wheels 62 are received within the cylindrically-shaped tube 36 with the wheel brackets 64 extending through the slot 38. The wheel brackets 64 are mounted to the first end 56 and the second end 58 of the upper horizontal arm 54, respectively.

The first movable frame 52 also includes a centrally positioned vertical strut unitary or rod 66 that extends along a vertical axis that is parallel to the axis Z in the vertical direction. The vertical strut 66 is a cylindrical tube or cylindrically shaped. An upper end 68 of the vertical strut 66 attaches to the midportion of the upper horizontal arm 54. A lower end portion 70 of the vertical strut 66 is secured to a pair of rollers 72 forming a lower roller assembly 73. The pair of rollers 72 are pivotally secured to the vertical strut 66 and arranged to receive the rod 42 therebetween. Clamps 98 are provided to secure a pair of rollers 72 to the vertical strut 66. The roller assemblies 60 and pair of rollers 72 permit the first movable frame 52 to move in the longitudinal direction along axis X via the upper track 32 and the lower track 34.

The first movable frame 52 also includes a lower horizontal arm 74 secured to the upper horizontal arm 54 via two angled brackets 76.

The movable carriage assembly 50 also includes a second movable frame 80. The second movable frame 80 includes a horizontal ladder support arm 82 having a first end 84 and a second end 86. The first end 84 is secured to a vertical arm 88. The vertical arm 88 is a cylindrical sleeve and is slidably received by the vertical strut 66. The first end 84 of the horizontal ladder support arm 82 is secured to an upper portion 90 of the vertical arm 88. An angled strut 92 has one end secured to the second end 86 of the horizontal ladder support arm 82 and another end of the angled strut 92 is secured to a midportion of the vertical arm 88. A spacer sleeve 94, as shown in FIGS. 2A–5, is received by the vertical strut 66 and is positioned on the lower end portion 70 of the vertical strut 66. A lower end of the vertical arm 88 rests on an upper surface of the spacer sleeve 94 or a support bracket 95 mounted to the vertical strut 66 if the spacer sleeve 94 is not provided. When the spacer sleeve 94 is provided, a lower end of the spacer sleeve 94 abuts against the support bracket 95. The support bracket 95 corresponds to the lower horizontal arm 70.

Figure 8:
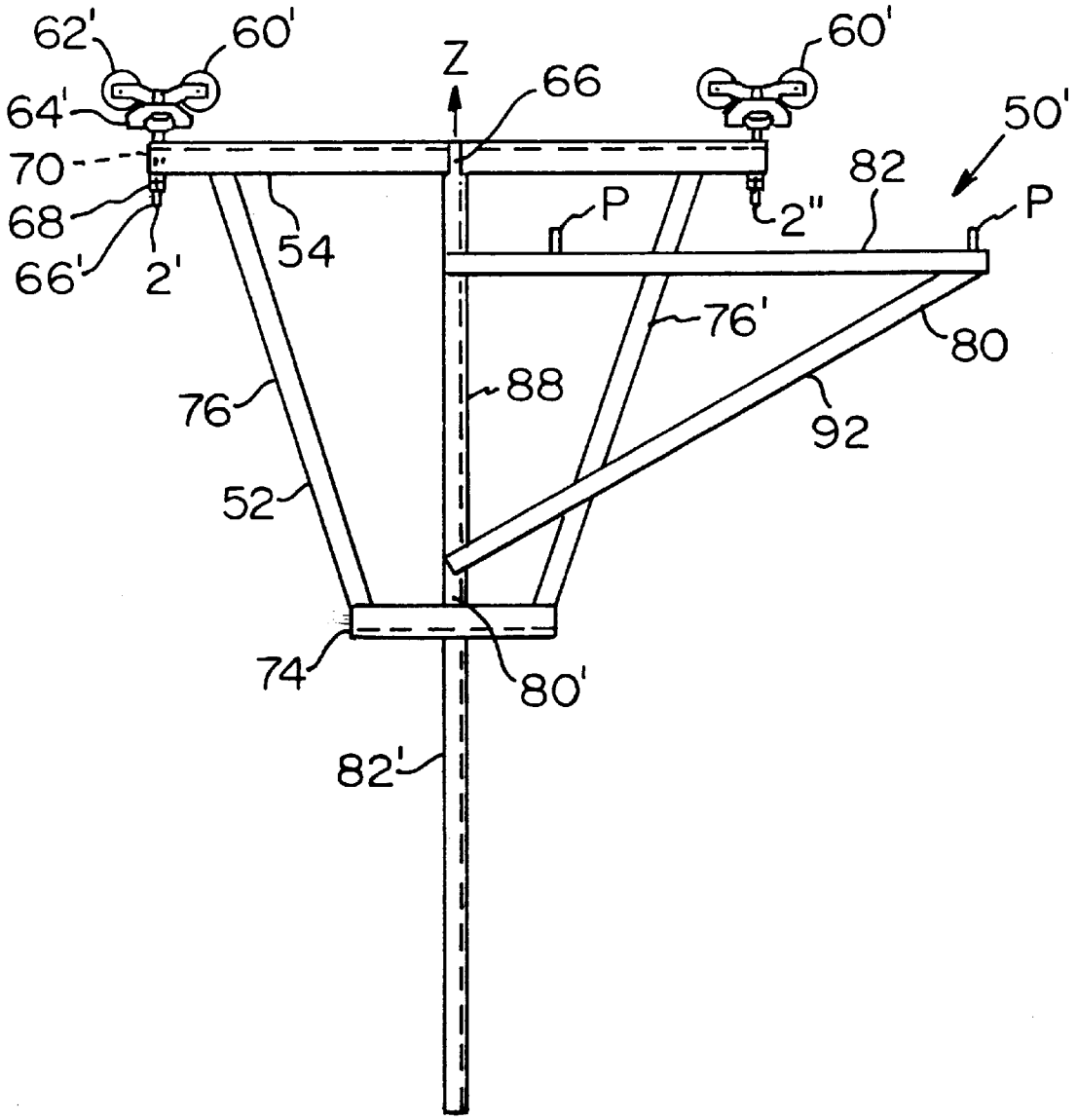
FIG. 8 is an elevational view of a portion of another embodiment of the ladder system.

As shown in FIGS. 2A–4 and 6, an upper end 100 of the vertical strut 66 has a stop 103 that includes a washer 104. A collar 102 is provided on the upper horizontal arm 54. The vertical strut 66 passes through the collar 102 until the washer 104 abuts against the collar 102. A pin passes through the collar 102 and passes through the upper end portion 68 of the vertical strut 66 to hold the vertical strut 66 in place. Alternatively, the pin and the collar 102 may be eliminated as shown in FIG. 8. The stop 103 coacts with the upper horizontal arm 54 so that the washer 100 prevents downward movement of the vertical strut 66 relative to the vertical arm 88 and the collar 102 and pin prevent upward and downward movement of the vertical strut 66 relative to the vertical arm 88. The bottom end portion 96 of the vertical strut 66 extends below the clamps 98. The length of bottom end portion 96 extending below the clamps 98 varies from case-to-case depending on the spacing between the upper track 32 and the lower track 34.

Appropriate hardware is provided to mount the ladder 18 to the movable carriage assembly 30. Pivot lugs P can be provided so that the ladder 18 pivots about an axis A parallel to the horizontal ladder support arm 82.

In operation, the second movable frame 80 through the coaction between the vertical arm 88 and the vertical strut 66 permits the second movable frame 80 and the ladder 18 to swing in a lateral direction relative to the movable carriage assembly 50 thereby repositioning the ladder 18 relative to the front face of the storage rack 12. The upper roller assemblies 60 and the lower rollers or the pair of rollers 72 are movable along the upper track 32 and the lower track 34, respectively, as the movable carriage assembly 50 and the ladder 18 are moved in the longitudinal direction along axis X parallel to the front face of the storage rack 12. The vertical strut 66 and the vertical arm 88 extend along the same vertical axis or longitudinal axis Z' and the vertical arm 88 is pivotable about the vertical axis Z' and the vertical arm is pivotable about the vertical axis Z' relative to the vertical strut and the tracks 32 and 34.

Various sized spacer sleeves 94 can be provided or no spacer sleeves 94 can be provided so that the height of the upper track 32 and the lower track 34 can vary while maintaining a constant height of the ladder platform 28. For example, it is preferable to maintain the platform height of the platform 28 to 150 inches from a supporting floor F. However, in many cases, the upper track height may vary as well as the position of the lower track 34. The present invention permits this variation by providing a variety of spacer sleeves or adjustment sleeves 94 and 94' (such as two inches and four inches in height, respectively) to adjust the height of the vertical arm 88 relative to the supporting floor F. The vertical arm 88 slidably rests on an upper surface of the respective spacer sleeves 94 or 94' so that when the ladder 18 and the platform 28 are secured to the second movable frame 80, the platform height remains a constant 150 inches.

As shall now be evident, the present invention does not require the upper and lower pivot means as required by the dual track mounted pivoting ladder assembly as disclosed in U.S. Pat. No. 5,653,307. Further, the present invention can be mounted on the upper track 32 and the lower track 34 which have a variable height relative to the supporting floor F. The present invention, through the use of the spacer sleeves 94 or 94', can accommodate various spaced tracks, which is not possible in the prior art dual track mounted pivoting ladder assembly.

The present invention also includes a kit incorporating the above-described elements. The kit can include a plurality of track segments for forming the upper track 32 and the lower track 34. The method for assembling the kit includes securing the plurality of the track segments to the storage rack 12 to define an upper track 32 and a lower track 34 extending in the horizontal direction. The upper track 32 is positioned above the lower track which are parallel to each other. The upper roller assemblies 60 are secured to the upper track 32 and the lower roller assembly is secured to the lower track 34; the roller assemblies 60 and 73 are secured to a carriage assembly 50, which includes the upper roller assemblies 60 secured to the upper horizontal arm 54 and the lower roller assembly 73 secured to the vertical strut 66. The ladder 18 is secured to the arm 88 through the horizontal ladder support arm 82. Once the arrangement is built, the ladder 18 can move along the upper track 32 and lower track 34 in a horizontal direction and rotate about a vertical axis passing through the vertical strut 66, further, the height of the carriage assembly 50 may be adjusted through the use of adjust sleeves 94 and 94' that are slidably received on the vertical strut 66 so that the vertical arm 88 can rest thereupon.

Figure 7:
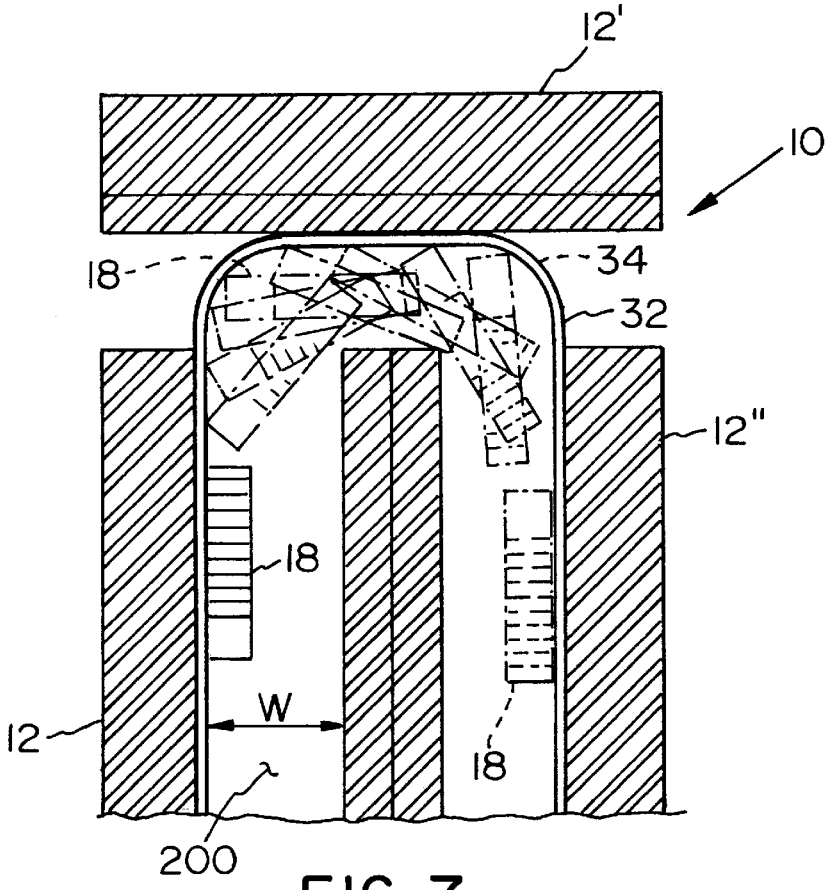
FIG. 7 is a top plan view of a plurality of storage racks having a U-shaped track.

FIG. 7 shows another embodiment of the present invention wherein the upper track 32 and the lower track 34 include U-shaped or curved portions so that the upper track 32 and lower track can be positioned on more than one face of a plurality of storage racks 12 and 12'. Storage racks 12, 12' and 12" are spaced apart by an aisle zoo. The ladder assembly 10, including the ladder 18, can travel on the tracks 32 and 34 and be positioned adjacent to more than one face of a plurality of the storage racks 12, 12' and 12". The width w of the aisle is sufficient to permit the ladder to be positioned adjacent the faces of the racks 12, 12' and 12", as shown in phantom.

FIG. 8 shows another embodiment of a movable carriage assembly 50' similar to movable carriage assembly 50. The only difference between the movable carriage assemblies 50 and 50' is roller assemblies 60'. Each roller assembly 60' includes pivotable wheels 62' secured to a wheel bracket 64'. A threaded rod 66' is secured to the wheel bracket 641. The thread rods 66' pass through the upper horizontal arm 54. Appropriate fasteners 68' and bushings 70' (shown in phantom) are provided so that the roller assemblies 60' can pivot about axes z' and z" relative to the horizontal arm 54 which are parallel to axis z. The bushings 70' abut against a lower surface of the horizontal arm 50'. The movable carriage 50' roller assemblies 60' can pivot about the axes z' and z" unlike the roller assemblies 60. This arrangement permits the movable carriage assembly 50' to travel on the U-shaped track shown in FIG. 7 and "float" on straight portions of the upper track 32 and the lower track 34 should that track become slightly curved. The lower roller assembly 72 (not shown in FIG. 8) require an arrangement to permit rotation about z axis relative to the vertical strut 66 to travel on the U-shaped track. Also, as shown in FIG. 8, the vertical strut 66 rests on a support bracket 80' attached to the lower horizontal arm 74. Spacer sleeves 94 and 94' (previously shown in FIGS. 2C and 4) can rest on the support bracket

80'. An outer square hollow sleeve 82' can be provided and attached to the lower horizontal arm 74 for receipt of a lower portion of the vertical strut 66. The clamps 98 can then be secured to the sleeve 82'.

Having described the presently preferred embodiments of my invention, it is to be understood that it may otherwise be embodied within the scope of the appended claims.

I claim:

1. A ladder, comprising:

a ladder frame; a plurality of steps secured to said ladder frame;

a movable frame, said movable frame comprising an upper horizontal arm, a lower horizontal arm, and two side arms, said upper horizontal arm secured to said lower horizontal arm through said side arms;

carriage assembly secured to said ladder frame, said carriage assembly comprising: a sleeve and a unitary rod slidably received by said sleeve, said carriage assembly extending along a longitudinal axis, said sleeve secured to said ladder frame and said rod secured to said movable frame, said rod extending through said upper horizontal arm and said lower horizontal arm and said sleeve positioned between said upper horizontal arm and said lower horizontal arm, said rod connected at an upper portion to said upper horizontal arm, whereby said ladder frame and said sleeve secured to said ladder frame are pivotable about the longitudinal axis relative to said rod; and an upper roller assembly attached to said movable frame and positioned above said upper horizontal arm and a lower roller assembly attached to a lower portion of said rod and positioned below said lower horizontal arm, said sleeve positioned between said upper roller assembly and said lower roller assembly.

2. A ladder as claimed in claim 1, wherein said ladder frame includes a lower end and an upper end, said carriage assembly secured to said upper end of said ladder frame.

3. A ladder as claimed in claim 1, further comprising a platform secured to ladder frame and positioned above said steps.

4. A ladder as claimed in claim 1, further comprising rollers attached to said lower end of said ladder frame, said rollers adapted to roll on a floor.

5. A ladder as claimed in claim 1, wherein said steps extend along the longitudinal axis.

6. A ladder as claimed in claim 1, further comprising a stop secured to an upper end of said rod coacting with said upper horizontal arm.

7. A ladder as claimed in claim 1, wherein said stop comprises a flange, said movable frame further comprising a collar secured to said upper horizontal frame, said collar receives said rod and is positioned between said washer and said upper horizontal frame, said washer prevents downward movement of said rod relative to said movable frame.

8. A ladder as claimed in claim 1, further comprising an adjustment sleeve slidably received to said rod and positioned between said sleeve and said movable frame and positioned below said sleeve, said sleeve rests on said adjustment sleeve, said adjustment sleeve adapted to adjust a height of said sleeve relative to a floor.

9. A ladder as claimed in claim 1, wherein said lower roller assembly is secured to said rod through a clamp assembly having two longitudinally spaced clamps.

10. A ladder as claimed in claim 1, further comprising, a horizontally extending arm attached to said sleeve and said ladder frame and an angled strut secured to said horizontally extending arm and said sleeve.

11. A ladder as claimed in claim 10, wherein said angled strut is secured to said sleeve between ends of said sleeve.

12. A ladder as claimed in claim 1, further comprising:

a stop secured to an upper end of said rod coacting with said upper horizontal member;

a collar secured to said upper horizontal frame, said collar receiving said rod and is positioned between said washer and said upper horizontal frame, said stop preventing downwardly movement of said rod relative to said movable frame;

an adjustment sleeve, slidably received to said rod and positioned between said sleeve and said movable frame and positioned below said sleeve, said sleeve resting on said adjustment sleeve, said sleeve adjustment configured to adjust a height of said sleeve relative to a floor;

a horizontally extending arm attached to said sleeve and rod ladder frame; and an angled strut secured to said horizontally extending arm and said sleeve.

13. A ladder as claimed in claim 1, wherein said upper roller assembly is pivotable about an axis parallel to the longitudinal axis relative to said movable frame.

14. A ladder as claimed in claim 13, further comprising a second upper roller assembly attached to said movable frame pivotable about an axis parallel to the longitudinal axis relative to said movable frame, said second upper roller assembly spaced apart from said upper roller assembly.

15. A track ladder for use with a storage rack, said track ladder, comprising:

an upper track extending in a horizontal direction, a lower track extending in the horizontal direction, said upper track and said lower track spaced apart from and parallel to each other; and a ladder, comprising:

a ladder frame;

a plurality of steps secured to said ladder frame; a movable frame said movable frame comprising an upper horizontal arm, a lower horizontal arm, and two side arms, said upper horizontal arm secured to said lower horizontal arm through said side arms;

a carriage assembly secured to said ladder frame, said carriage assembly comprising: a sleeve and a unitary rod slidably received by said sleeve, said carriage assembly extending along a longitudinal axis, said sleeve secured to said ladder frame and said rod secured to said movable frame, said rod extending through said upper horizontal arm and said lower horizontal arm and said sleeve positioned between said upper horizontal arm and said lower horizontal arm, said rod connected at an upper portion to said upper horizontal arm, whereby said ladder frame and said sleeve secured to said ladder frame are pivotable about the longitudinal axis relative to said rod; and an upper roller assembly attached to said movable frame and positioned above said upper horizontal arm and a lower roller assembly attached to a lower portion of said rod and positioned below said lower horizontal arm, said sleeve positioned between said upper roller assembly and said lower roller assembly, said upper roller assembly received by said upper track and said lower roller assembly received by said lower track, whereby said ladder can move in the horizontal direction along said upper track and said lower track, and said ladder can rotate about the longitudinal axis relative to said upper track and said lower track.

16. A track ladder as claimed in claim 15, wherein said upper track and said lower track include curved portions.

17. A track ladder system, comprising:

a storage rack having a front face;

an upper track extending in a horizontal direction attached to said front face;

a lower track extending in the longitudinal direction, attached to said front face, said upper track and said lower track spaced apart from and parallel to each other; and a ladder comprising:

a ladder frame;

a plurality of steps secured to said ladder frame;

a movable frame, said movable frame comprising an upper horizontal arm, a lower horizontal arm, and two side arms, said upper horizontal arm secured to said lower horizontal arm through said side arms;

a carriage assembly secured to said ladder frame, said carriage assembly comprising: a sleeve and a unitary rod slidably received by said sleeve, said carriage assembly extending along a longitudinal axis, said sleeve secured to said ladder frame and said rod secured to said movable frame, said rod extending through said upper horizontal arm and said lower horizontal arm and said sleeve positioned between said upper horizontal arm and said lower horizontal arm, said rod connected at an upper portion to said upper horizontal arm, whereby said ladder frame and said sleeve secured to said ladder frame are pivotable about the longitudinal axis relative to said rod; and an upper roller assembly attached to said movable frame and positioned above said horizontal arm and a lower roller assembly attached to a lower portion of said rod and positioned below said lower horizontal arm, said sleeve positioned between said upper roller assembly and said lower roller assembly, whereby said ladder can move in the horizontal direction along said upper track and said lower track and said ladder can rotate about the longitudinal axis relative to said upper track and said lower track.

* * * * *

UNITED STATES PATENT AND TRADEMARK OFFICE

CERTIFICATE OF CORRECTION

PATENT NO. : 6,230,841 B1
DATED : May 15, 2001
INVENTOR(S) : Nicholas J. Valore

It is certified that error appears in the above-identified patent and that said Letters Patent is hereby corrected as shown below:

Column 4,
Line 43, "vertical strut unitary" should read -- vertical unitary strut --.

Column 10, claim 17,
Line 11, "said horizontal arm" should read -- said upper horizontal arm --.

Signed and Sealed this

Nineteenth Day of February, 2002

*Attest:*

*Attesting Officer*

JAMES E. ROGAN
*Director of the United States Patent and Trademark Office*